US009643752B2

(12) United States Patent
Wang

(10) Patent No.: US 9,643,752 B2
(45) Date of Patent: May 9, 2017

(54) STACKABLE STORAGE BOX

(71) Applicant: Color Mark Co., Ltd., Taichung (TW)

(72) Inventor: Hsi-Kun Wang, Taichung (TW)

(73) Assignee: Color Mark Co., Ltd., Taichung (TW)

( * ) Notice: Subject to any disclaimer, the term of this patent is extended or adjusted under 35 U.S.C. 154(b) by 259 days.

(21) Appl. No.: 14/695,095

(22) Filed: Apr. 24, 2015

(65) Prior Publication Data

US 2016/0311574 A1 Oct. 27, 2016

(51) Int. Cl.
*B65D 21/00* (2006.01)
*B65D 21/02* (2006.01)

(52) U.S. Cl.
CPC ..... *B65D 21/0223* (2013.01)

(58) Field of Classification Search
CPC ..... A47B 87/0223; A47B 87/0253; B65D 21/0217; B65D 21/0219; B65D 21/022; B65D 21/0222; B65D 21/0223; B65D 21/0226; B65D 21/02; B65D 21/0201; B65D 21/0204; B65D 21/0209; B65D 21/023
USPC ..... 220/23.83, 23.86, 23.2, 23.4, 23.6; 206/508, 509, 501; 211/144
See application file for complete search history.

(56) References Cited

U.S. PATENT DOCUMENTS 4,413,867 A * 11/1983 Mosebrook ..... A47B 87/02 108/91
4,807,773 A * 2/1989 Tsai ..... A45D 33/24 132/296
8,322,354 B2 * 12/2012 Parker ..... A45D 33/20 132/287

* cited by examiner

*Primary Examiner* — Jeffrey Allen
(74) *Attorney, Agent, or Firm* — Alan D. Kamrath; Kamrath IP Lawfirm, P.A.

(57) ABSTRACT

A stackable storage box includes an upper box body and at least one modular storage unit. The upper box body includes a box bottom having a rotary portion and a positioning portion. The modular storage unit includes a lower base, an upper base and a drawer. The lower base includes a lower rotary portion and a lower positioning portion. The upper base includes an upper rotary portion and an upper positioning portion. The upper rotary portion is rotatably coupled with the rotary portion of the upper box body. The upper positioning portion is coupled with the positioning portion of the upper box body for positioning when the modular storage unit relative to the upper box body is rotated by a specific angle. A plurality of modular storage units can be rotatably stacked relative to one another and positioned with the upper and lower positioning portions combined.

10 Claims, 14 Drawing Sheets

STACKABLE STORAGE BOX

BACKGROUND OF THE INVENTION

The present invention relates to a stackable storage box and, more particularly, to a stackable storage box with a plurality of storage units which can be stacked as required and freely turned in different directions for orientations of drawers.

In general, the articles for daily use (for example, stationery, tools, invoices, cosmetics, etc.) need to be held in several containers separately. For less storage space occupied, cosmetics such as eye shadow, rouge, blusher and nail polish are usually held in a stackable multi-layered dressing case or storage box. The structure of a conventional multi-layered storage box includes a base and a plurality of drawers accommodated and stacked in the base. The drawers can be respectively pulled out of or pushed into the storage box for access to articles held inside.

Despite the function to systematically accommodate articles for daily use, the conventional multi-layered storage box includes several components structurally different to one another in general. Therefore, the manufacture costs are high because theses components are individually manufactured with multiple molds. Furthermore, in the conventional multi-layered storage box with drawers pulled out in an identical direction, the lower drawers in the multiple stacked ones, which are opened simultaneously, are sheltered by the upper drawers so that articles in the lower drawers keep unobserved from outside. As such, articles held in the storage box are neither exhibited completely nor accessed easily.

BRIEF SUMMARY OF THE INVENTION

It is an objective of the present invention to provide a stackable storage box for improving the above mentioned problems. The stackable storage box of the present invention includes a plurality of modular storage units that classify and accommodate articles for daily use such as stationery and cosmetics. The modular storage units can be stacked and combined for development of several appropriate layers of storage units as required and can be freely rotated to different directions in which drawers of all storage units not sheltering one another can be pulled out for exhibition of and access to articles held in the storage box. The modular storage units are structurally identical to each other for a lower-cost mold used in manufacture of the modular storage units.

To achieve this and other objectives, a stackable storage box of the present invention includes an upper box body and a first storage unit rotatably coupled with and located under the upper box body. The upper box body includes a box bottom and a box lid pivotally fitted at the box bottom. The box bottom includes a bottom panel and a wall panel upward extending from the bottom panel. The bottom panel is provided with a rotary portion and a positioning portion located on a bottom surface of the bottom panel and including a plurality of indents circularly distributed. The first storage unit includes a lower base, an upper base, and a drawer. The lower base includes a lower base plate having a storage space therein. The lower base plate is provided with a lower rotary portion and a lower positioning portion located on a bottom surface of the lower base plate and including a plurality of indents circularly distributed. The upper base is coupled with the lower base and includes an upper base plate spaced from the lower base plate of the lower base. The upper base plate includes a top surface on which an upper rotary portion rotatably coupled with the rotary portion of the box bottom is designed. An upper positioning portion is formed on the top surface of the upper base plate and includes a plurality of convex portions circularly distributed and correspondingly coupled with the plurality of indents of the positioning portion of the box bottom.

In a form, the stackable storage box further includes a second storage unit rotatably coupled with and located under the first storage unit. The second storage unit includes a lower base, an upper base coupled with the lower base, and a drawer. The lower base of the second storage unit includes a lower base plate. The lower base plate of the second storage unit is provided with a lower rotary portion and a lower positioning portion located on a bottom surface thereof and including a plurality of indents circularly distributed. The upper base of the second storage unit includes an upper base plate having a top surface on which an upper rotary portion rotatably coupled with the lower rotary portion of the first storage unit is designed. An upper positioning portion is formed on the top surface of the upper base plate of the second storage unit and includes a plurality of convex portions circularly distributed and correspondingly coupled with the plurality of indents of the lower positioning portion of the first storage unit.

In a preferred form, the rotary portion is a round through-hole located within the positioning portion and penetrating from a top surface to the bottom surface of the bottom panel. The lower rotary portion is a round through-hole located within the lower positioning portion and penetrating from a top surface to the bottom surface of the lower base plate. The upper rotary portion is a round shaft collar located within the upper positioning portion and upward protruding from the top surface of the upper base plate. A plurality of elastic flaps is formed on the shaft collar, and two gaps are respectively defined in two sides of each elastic flap. Each elastic flap is flexibly movable in a radial direction of the shaft collar.

The present invention will become clearer in light of the following detailed description of illustrative embodiments of this invention described in connection with the drawings.

DETAILED DESCRIPTION OF THE INVENTION

Figure 1:
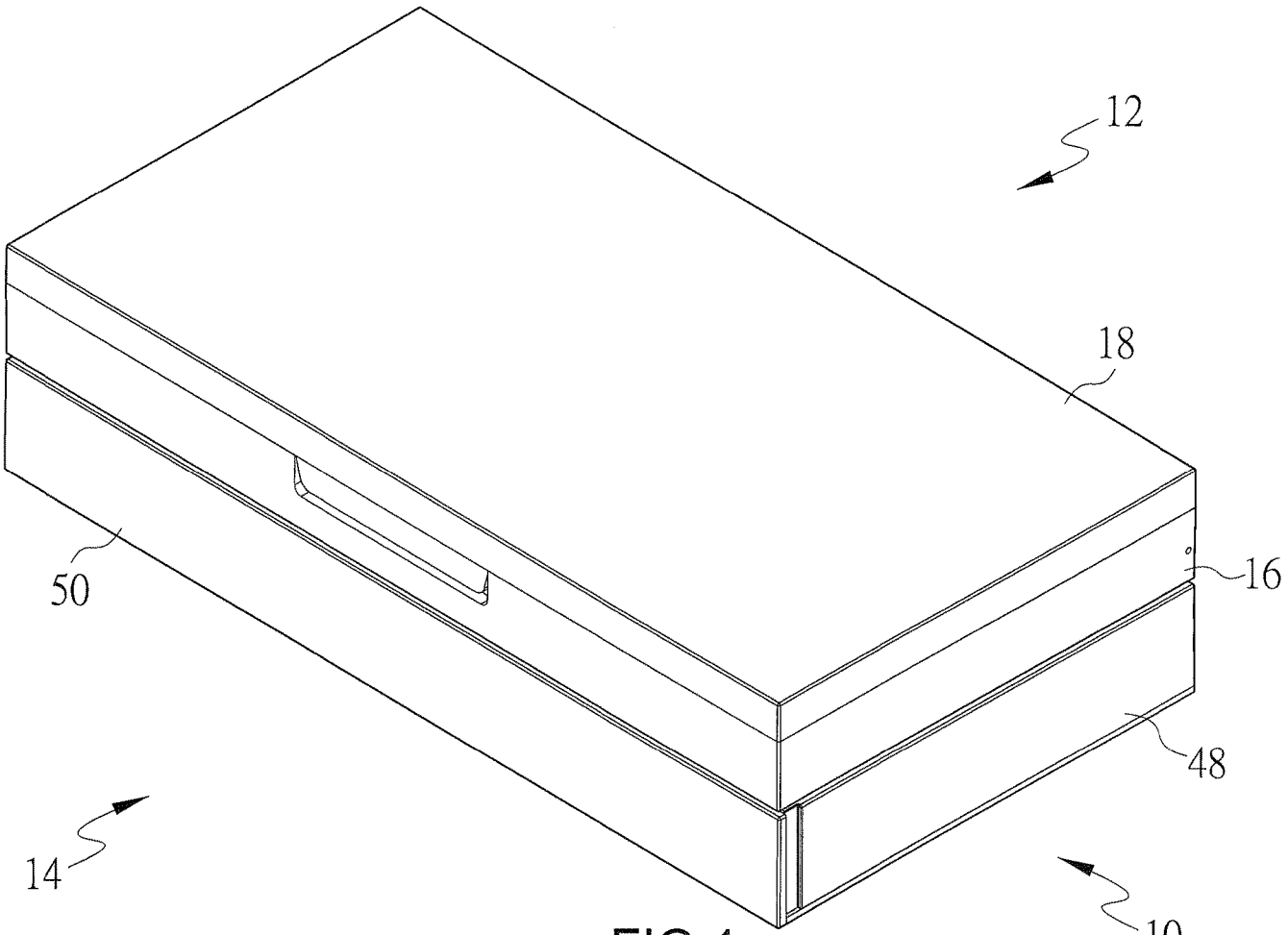
FIG. 1 shows a perspective view of a stackable storage box according to a first embodiment of the present invention.
Figure 2:
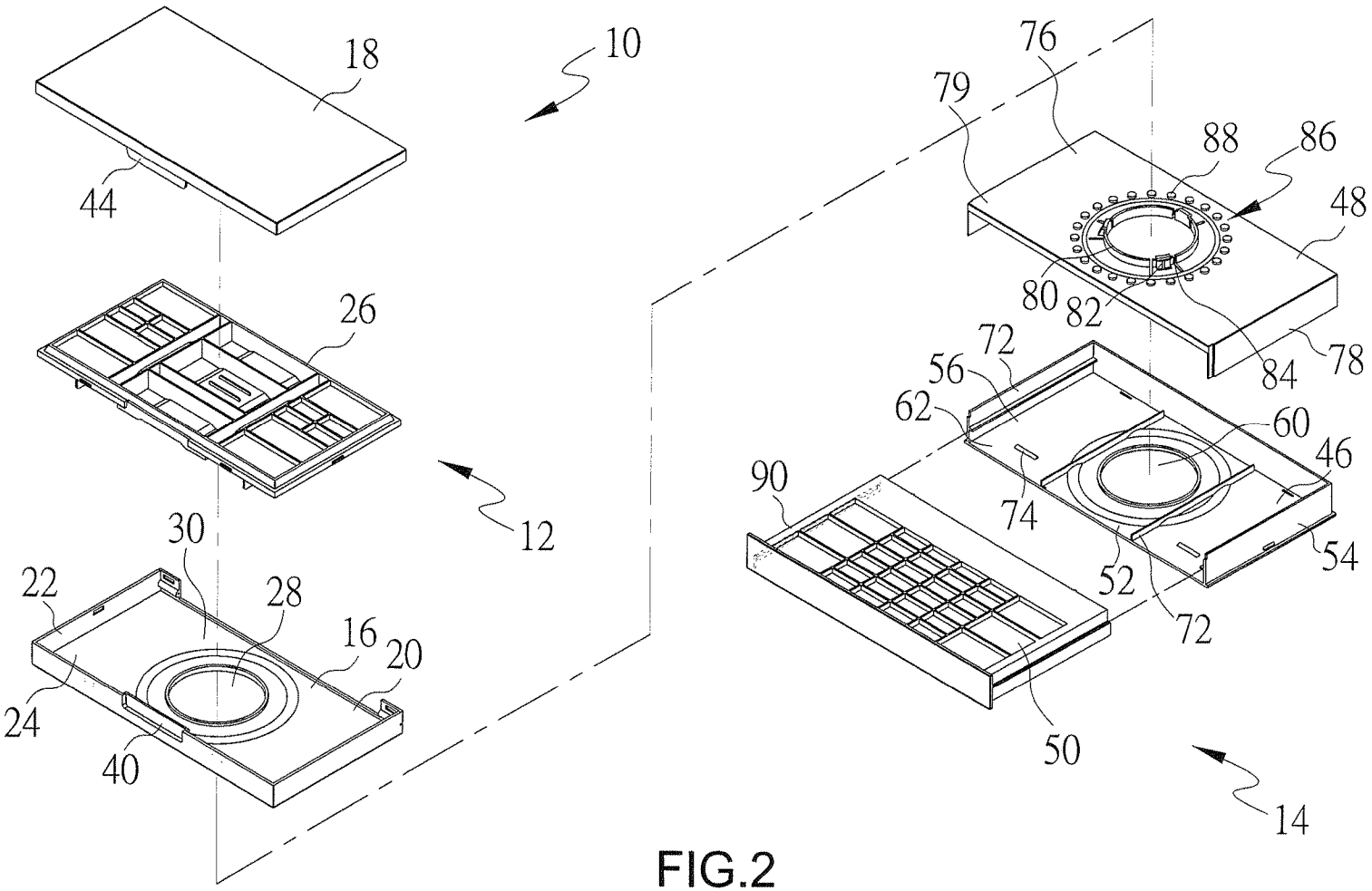
FIG. 2 is an exploded, perspective view of the storage box of FIG. 1.
Figure 3:
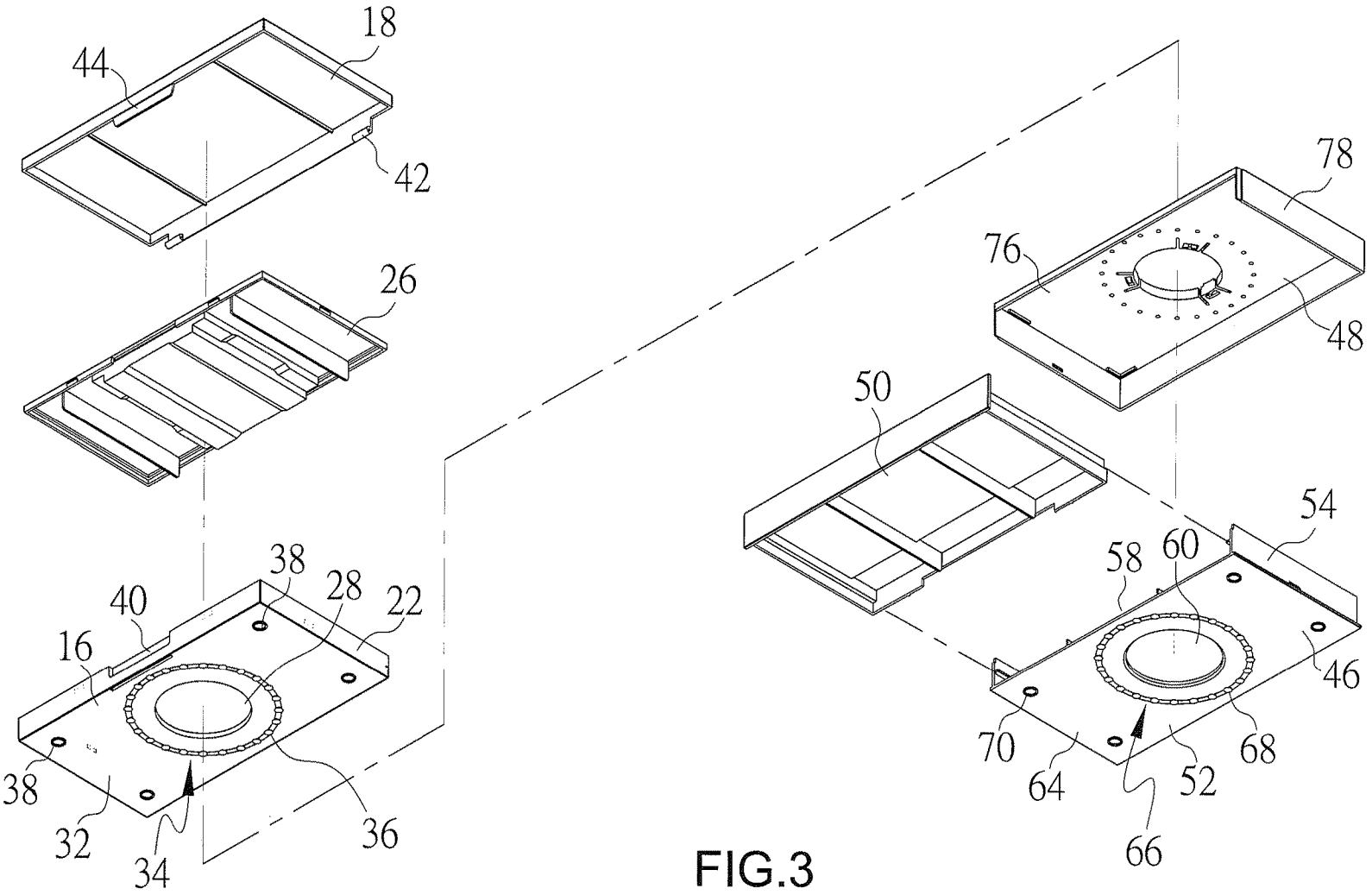
FIG. 3 shows another exploded, perspective view of the storage box of FIG. 1.
Figure 4:
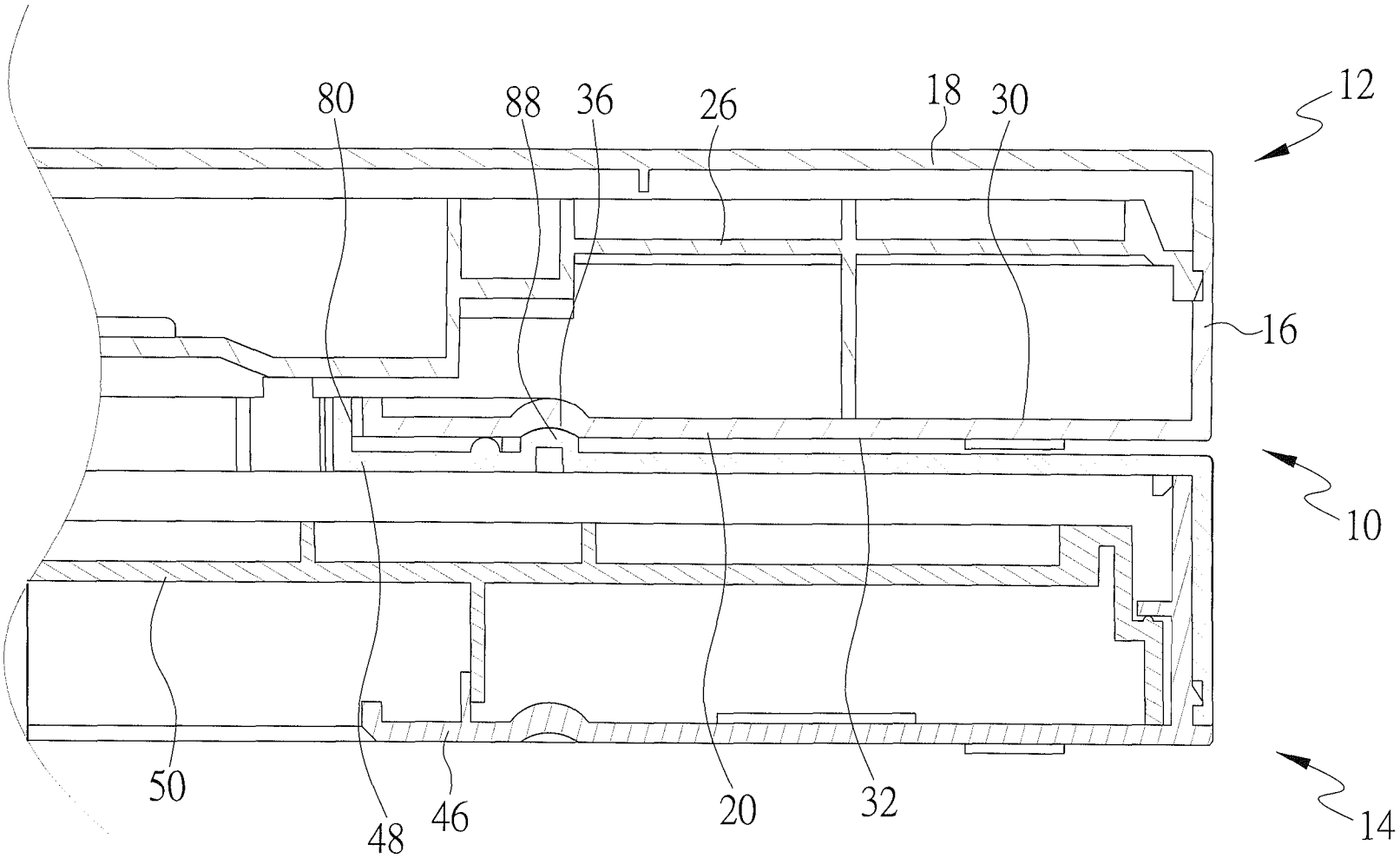
FIG. 4 is a partial sectional view of the storage box of FIG. 1.
Figure 5:
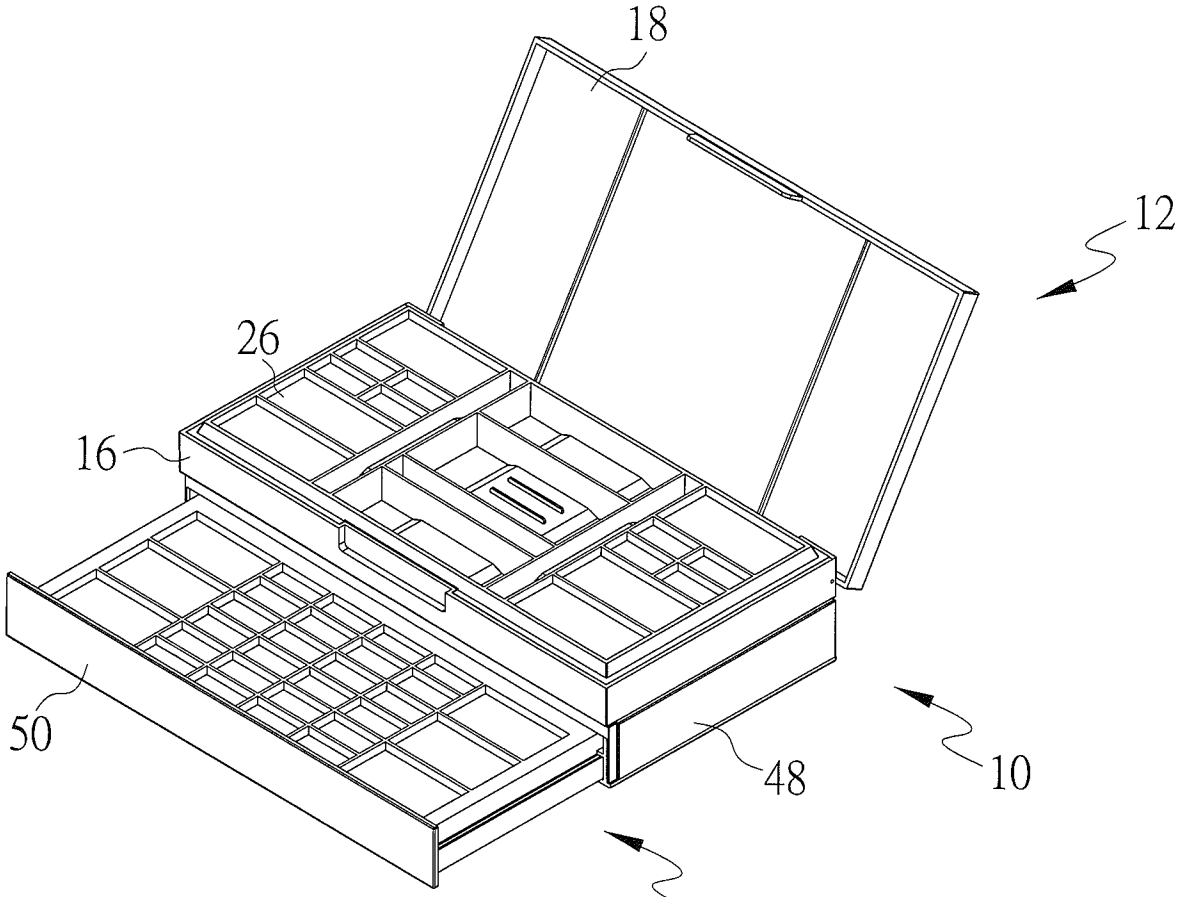
FIG. 5 is a schematic view illustrating a box lid opened and a drawer pulled out of the storage box in FIG. 1.
Figure 6:
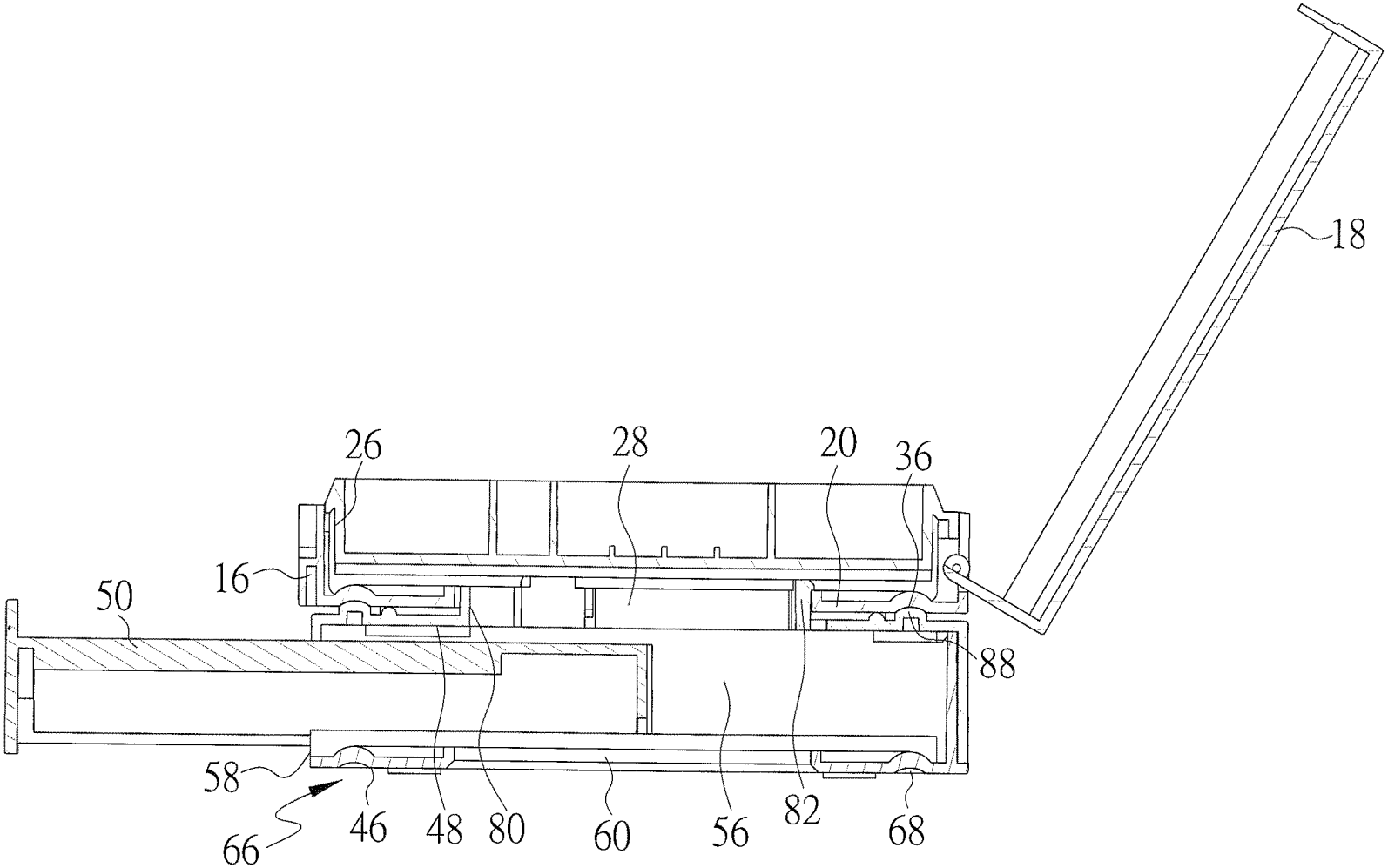
FIG. 6 is a sectional view of the storage box of FIG. 1, with the box lid opened and the drawer pulled out of the storage box.

A stackable storage box 10 according to a first embodiment of the present invention is shown in FIGS. 1 through 6 of the drawings and includes an upper box body 12 and at least one modular storage unit 14. The upper box body 12 includes a box bottom 16 and a box lid 18. The box bottom 16 includes a bottom panel 20 and a wall panel 22 upward extending from an edge of the bottom panel 20. The box bottom 16 internally defines a storage bay 24 to accommodate a tray 26 in which some articles for daily use such as cosmetics, sugars and stationery are placed. The bottom panel 20 is provided with a rotary portion 28. In this embodiment, the rotary portion 28 is a round through-hole penetrating from a top surface 30 to a bottom surface 32 of the bottom panel 20. On the bottom surface 32 of the bottom panel 20 is designed a positioning portion 34. In this embodiment, the positioning portion 34 includes a plurality of indents 36 distributed circularly and spaced at a constant angle, and the rotary portion 28 is located in the positioning portion 34. On the bottom surface 32 of the bottom panel 20 are further designed a plurality of non-slip pads 38 around corners. A snap-fit slot 40 is provided in the wall panel 22. At a rear side of the box lid 18 is equipped with pivotal portions 42 pivotally fitted at the box bottom 16, and a lug 44 is equipped on a front side of the box lid 18 and coupled with the snap-fit slot 40 when the box lid 18 is covered on the box bottom 16. As such, the box lid 18 is relative to the box bottom 16 for opening or closing.

The storage unit 14 includes a lower base 46, an upper base 48, and at least one drawer 50. The lower base 46 includes a lower base plate 52 and an enclosure 54 upward extending from an edge of the lower base plate 52. The lower base 46 internally defines a storage space 56 and an opening 58 in communication with the storage space 56. On the lower base plate 52 is designed a lower rotary portion 60. In this embodiment, the lower rotary portion 60 is a round through-hole penetrating from a top surface 62 to a bottom surface 64 of the lower base plate 52 and being identical to the rotary portion 28 of the upper box body 12 in diameter. On the bottom surface 64 of the lower base plate 52 is designed a lower positioning portion 66 which includes a plurality of indents 68 distributed circularly and spaced at a constant angle. The lower positioning portion 66 is structurally identical to the positioning portion 34 of the upper box body 12 and located around the lower rotary portion 60. On the bottom surface 64 of the lower base plate 52 are further designed non-slip pads 70 around corners. In this embodiment, on the top surface 62 of the lower base plate 52 are provided with a plurality of guide tracks 72 and a plurality of stop blocks 74. On an inner surface of the enclosure 54 are also provided with guide tracks 72.

The upper base 48 includes an upper base plate 76 and an enclosure 78 which downward extends from an edge of the upper base plate 76 and joins an exterior of the enclosure 54 on the lower base 46. As such, the upper base 48 is coupled with the lower base 46. The upper and lower base plates 76 and 52 are spaced from each other and collectively define the storage space 56 and the opening 58. On a top surface 79 of the upper base plate 76 is equipped with an upper rotary portion 80 which coordinates the rotary portion 28 of the box bottom 16 for a rotational combination. As such, the upper box body 12 is coupled with and rotatable relative to the upper base 48 of the storage unit 14. In this embodiment, the upper rotary portion 80 is a round shaft collar upward protruding from the top surface 79, having an outer diameter almost identical to a pore size of the rotary portion 28, and correspondingly penetrating the rotary portion 28 of the upper box body 12. A plurality of elastic flaps 82 is formed on the shaft collar, and two gaps 84 respectively define in two sides of each elastic flap 82, so that each elastic flap 82 is flexibly movable in a radial direction of the shaft collar. The plurality of elastic flaps 82 on the shaft collar allow the upper rotary portion 80 to be smoothly turned relative to the rotary portion 28. On the top surface 79 of the upper base plate 76 is further equipped with an upper positioning portion 86 which includes a plurality of convex portions 88 circularly distributed and spaced at a constant angle and located around the upper rotary portion 80. The convex portions 88 of the upper positioning portion 86 can be correspondingly coupled with the indents 36 of the positioning portion 34 for positioning. In an alternative embodiment, the upper positioning portion 86 includes a plurality of indents and the positioning portion 34 includes a plurality of convex portions correspondingly coupled with the plurality of indents. In a feasible embodiment, the upper rotary portion 80 is a through-hole and the rotary portion 28 of the upper box body 12 is a shaft collar correspondingly penetrating the through-hole.

The drawer 50 is movably held in the storage space 56 from the opening 58. In this embodiment, the drawer 50 has guide slots 90 corresponding to the guide tracks 72 of the lower base 46 and can be pulled out of or pushed into the storage space 56 steadily along the guide tracks 72. The drawer 50 which is pulled out and blocked by the stop blocks 74 is not separated from the storage space 56. Moreover, the drawer 50 is used to accommodate articles for daily use such as cosmetics, sugars, stationery, etc.

Figure 7:
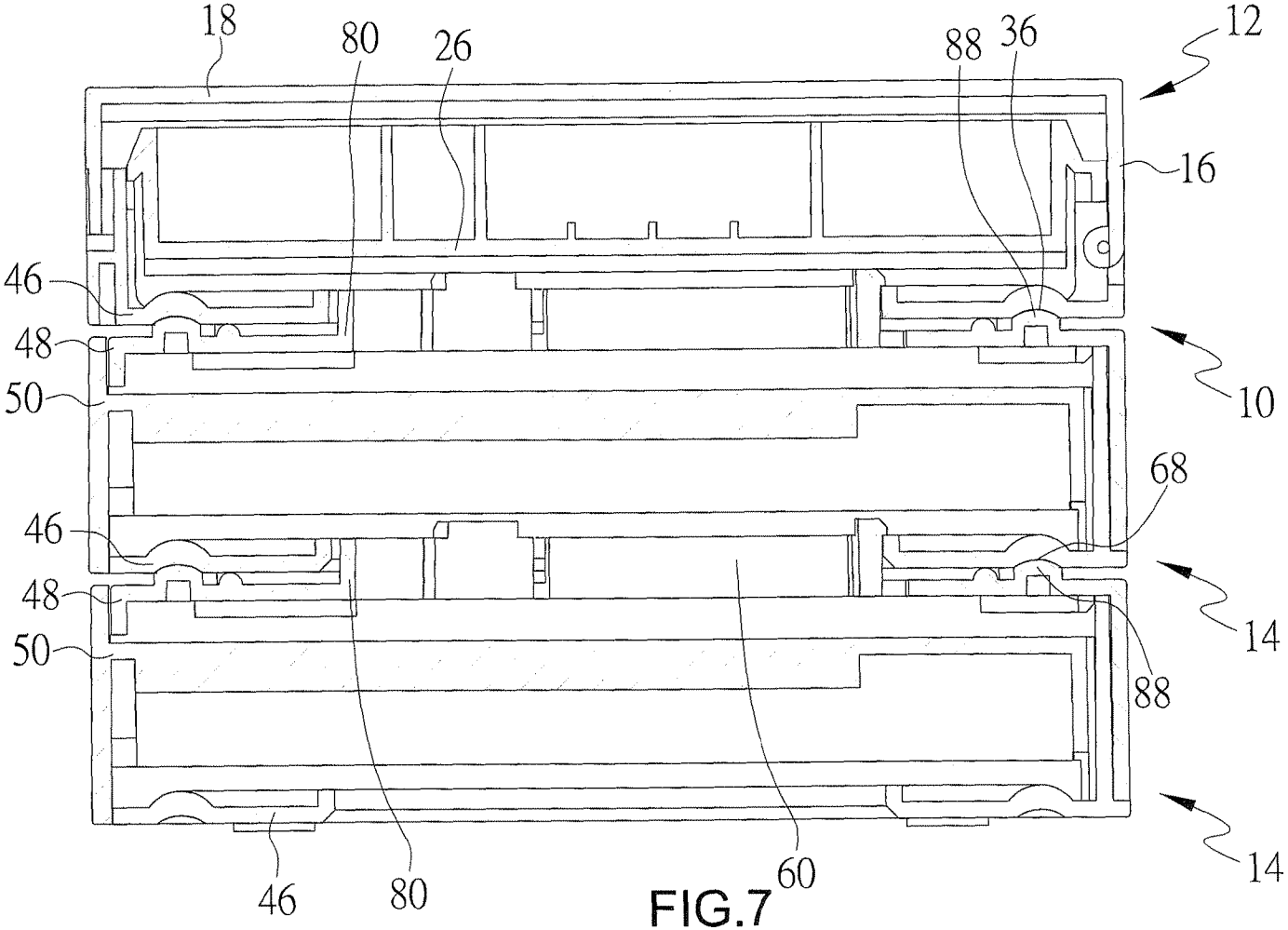
FIG. 7 is a sectional view of a stackable storage box according to a second embodiment of the present invention.
Figure 8:
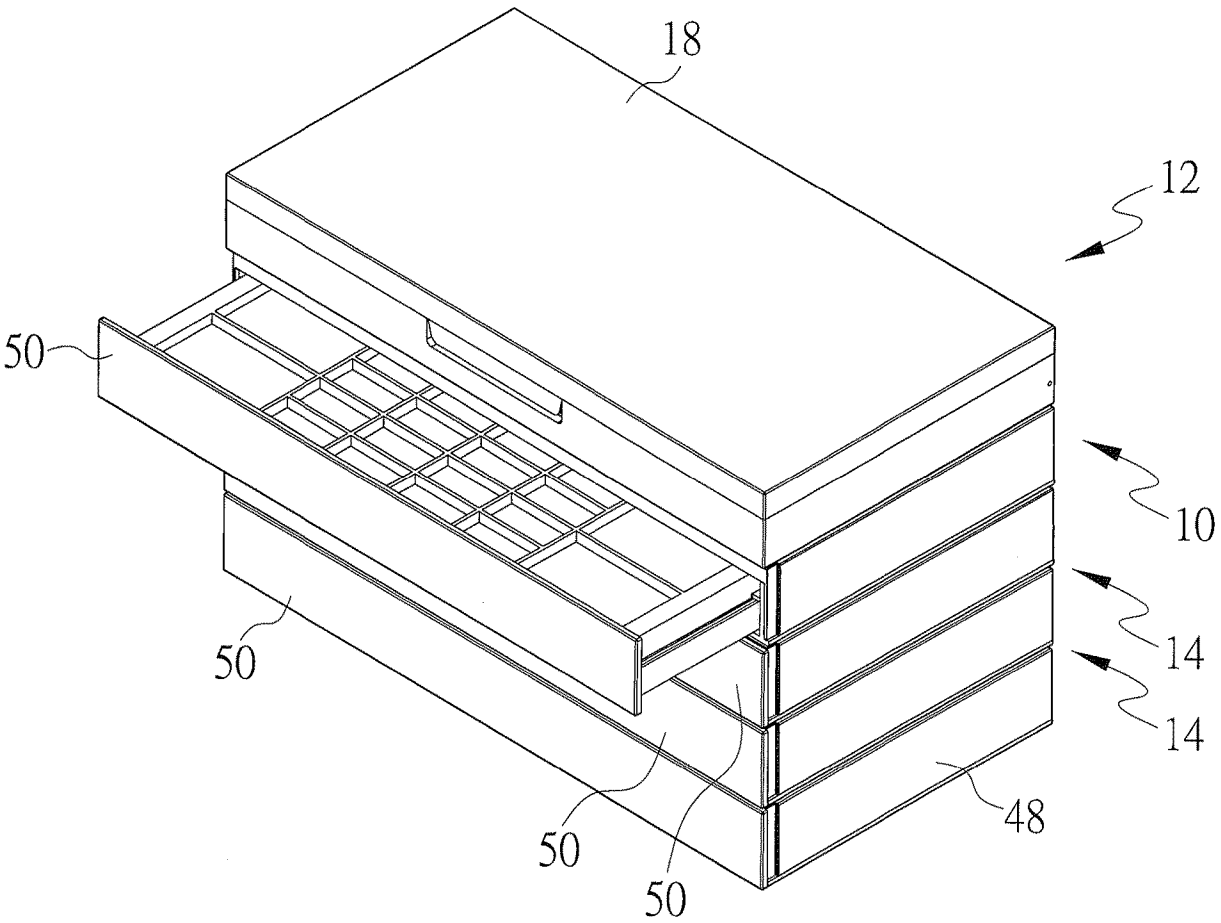
FIG. 8 shows a perspective view of a stackable storage box according to a third embodiment of the present invention.
Figure 9:
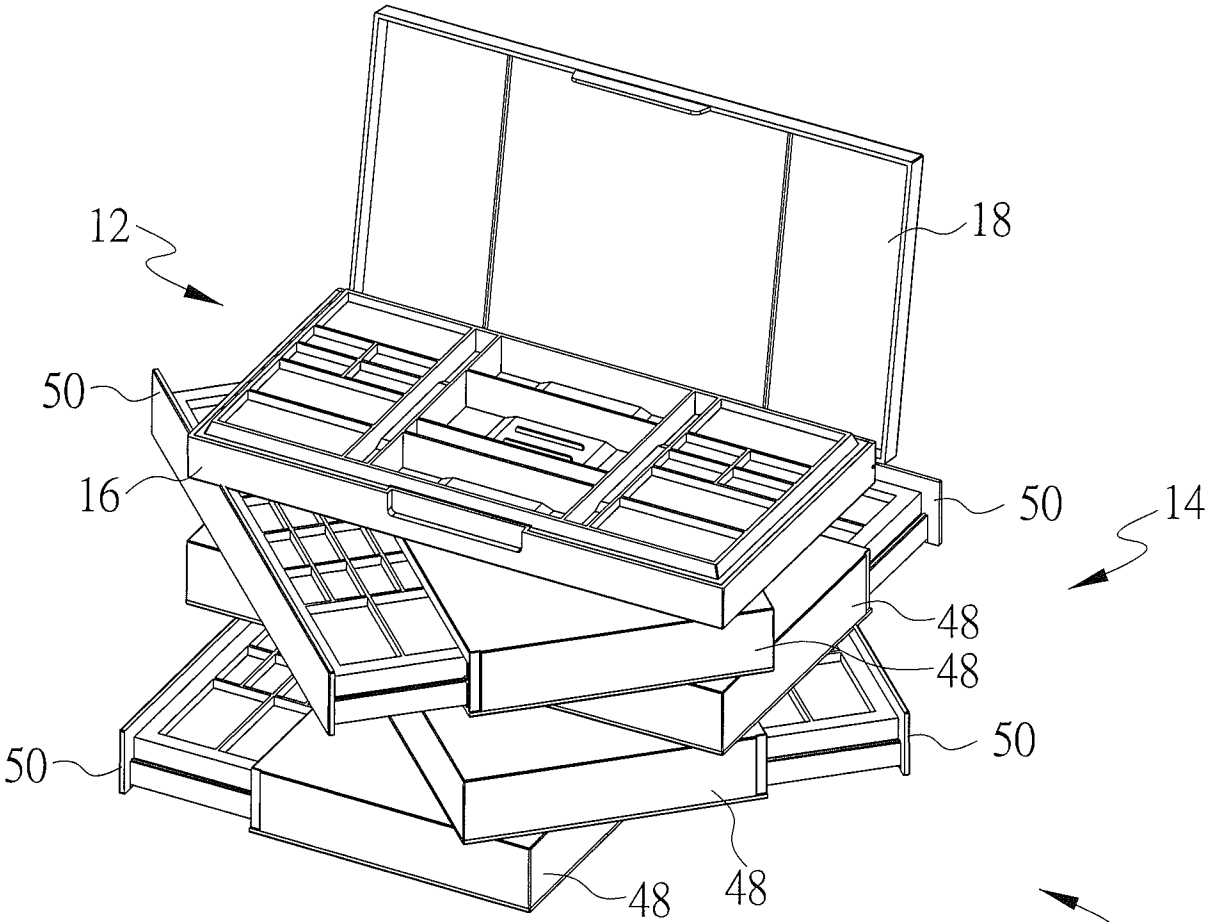
FIG. 9 is a schematic view illustrating storage units of the storage box in FIG. 8 rotated relative to an upper box body, a box lid opened, and drawers pulled out.

In this embodiment of FIG. 1 through FIG. 6, the storage box 10 includes one storage unit 14. In an alternative feasible embodiment, the storage box 10 may include several modular storage units 14. As shown in FIG. 7, the storage box 10 includes two modular storage units (first and second storage units) 14 which are structurally identical to each other for a lower-cost mold used in manufacture of the modular storage units 14. The lower base 46 of the first storage unit 14 under the upper box body 12 is stacked on the upper base 48 of the second storage unit 14 under the first storage unit 14, and the upper rotary portion 80 of the upper base 48 of the second storage unit 14 is rotatably coupled with the lower rotary portion 60 of the lower base 46 of the first storage unit 14. As such, the storage unit 14 at the lower layer is rotatably stacked under the other storage unit 14 at the upper layer. Each of the storage units 14 can be rotated and then positioned with the convex portions 88 of the upper positioning portion 86 joining the indents 68 of the lower positioning portion 66. As shown in FIGS. 8 and 9, the storage box 10 includes four modular storage units 14 structurally identical to one another and rotatably stacked under the upper box body 12. Two adjacent storage units 14 can be positioned with the upper positioning portion 86 and the lower positioning portion 66 combined. Furthermore, each of the storage units 14 can be turned as required for determination of a direction in which one of the drawers 50 held in the storage units 14 is pulled out (see FIG. 9). The drawers 50 in the storage units 14 are staggered and the lowered drawers 50 are not sheltered. As such, articles held in the storage box 10 are exhibited effectively and accessed easily.

Figure 10:
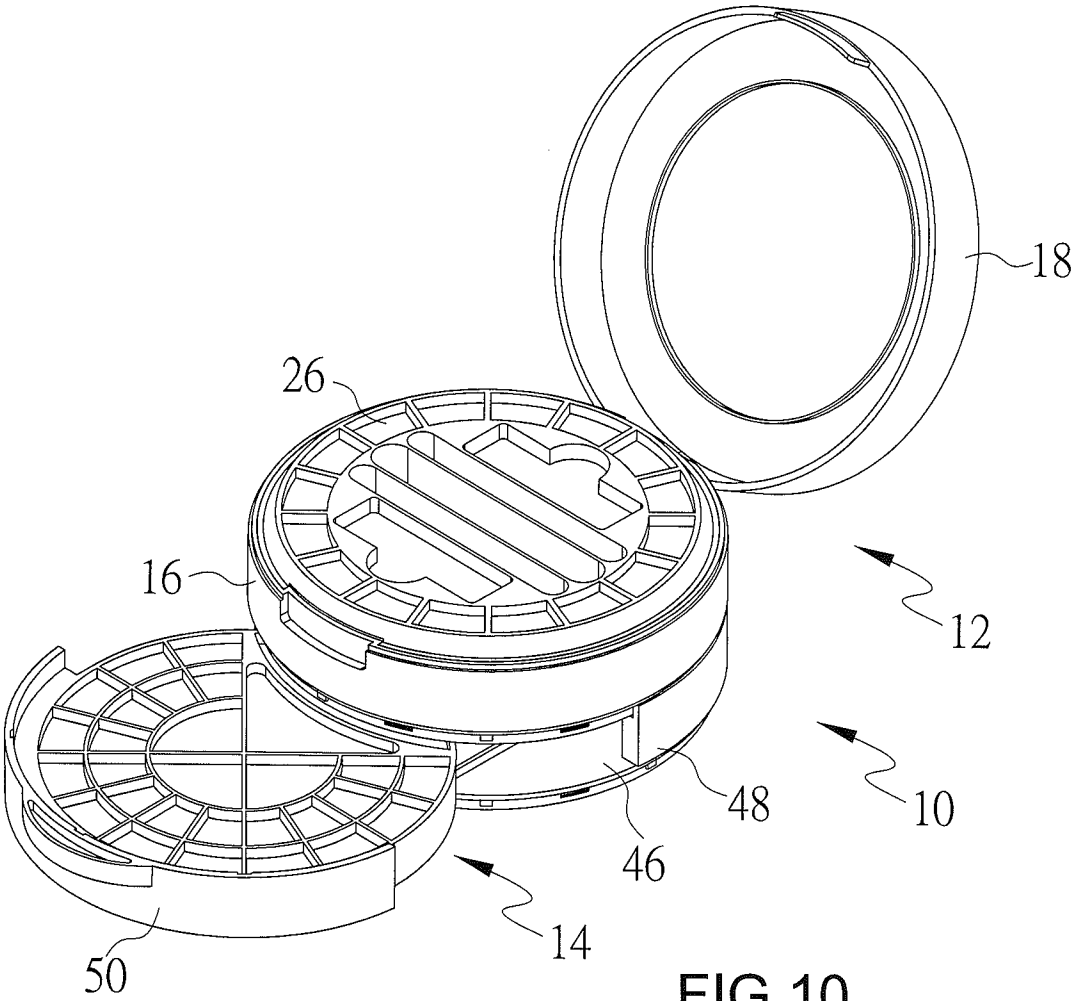
FIG. 10 shows a perspective view of a stackable storage box according to a fourth embodiment of the present invention.
Figure 11B:
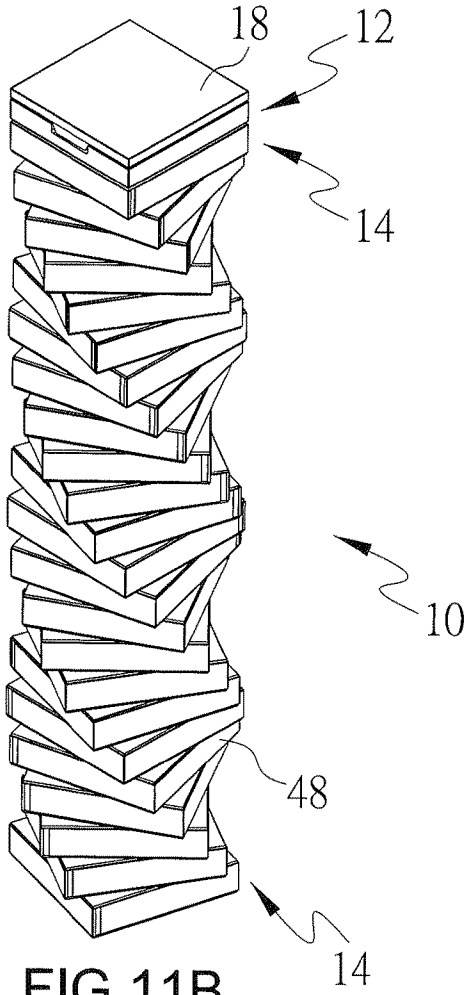
FIGS. 11A and 11B are a perspective view and a schematic view of a stackable storage box in use according to a fifth embodiment of the present invention, respectively.
Figure 11A:
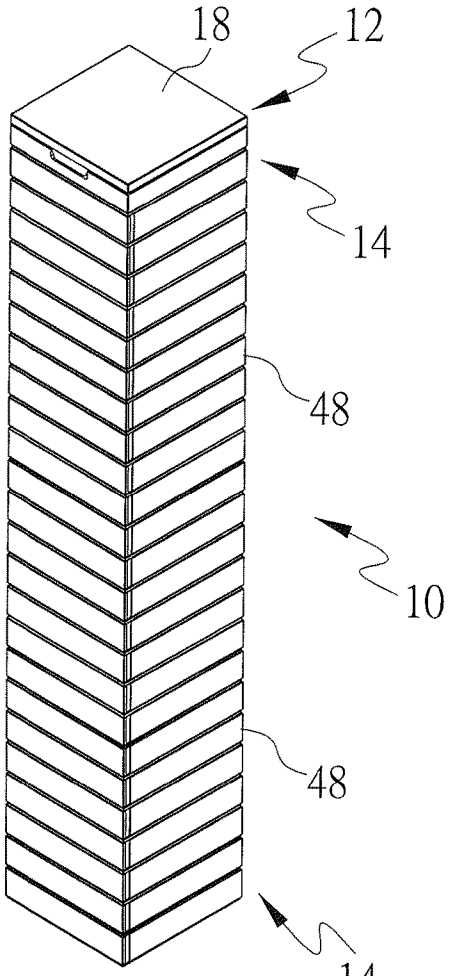
Figure 12B:
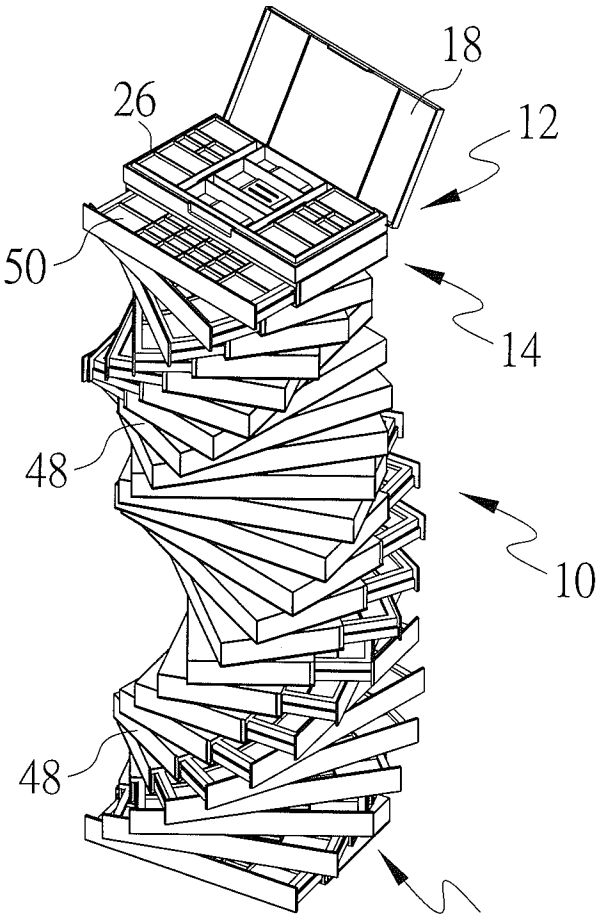
FIGS. 12A and 12B are a perspective view and a schematic view of a stackable storage box in use according to a sixth embodiment of the present invention, respectively.
Figure 12A:
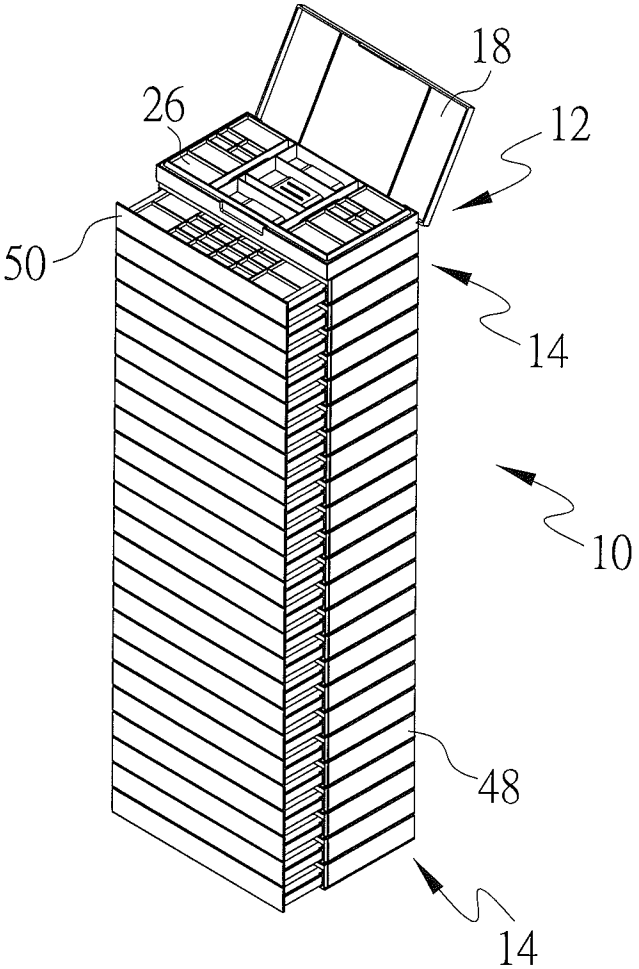
Figure 13B:
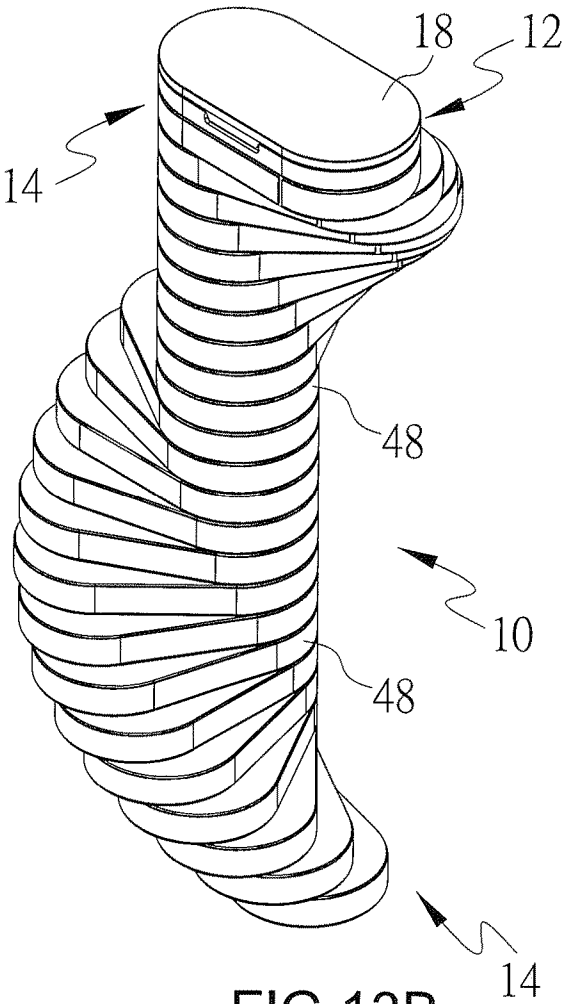
FIGS. 13A and 13B are a perspective view and a schematic view of a stackable storage box in use according to a seventh embodiment of the present invention, respectively.
Figure 13A:
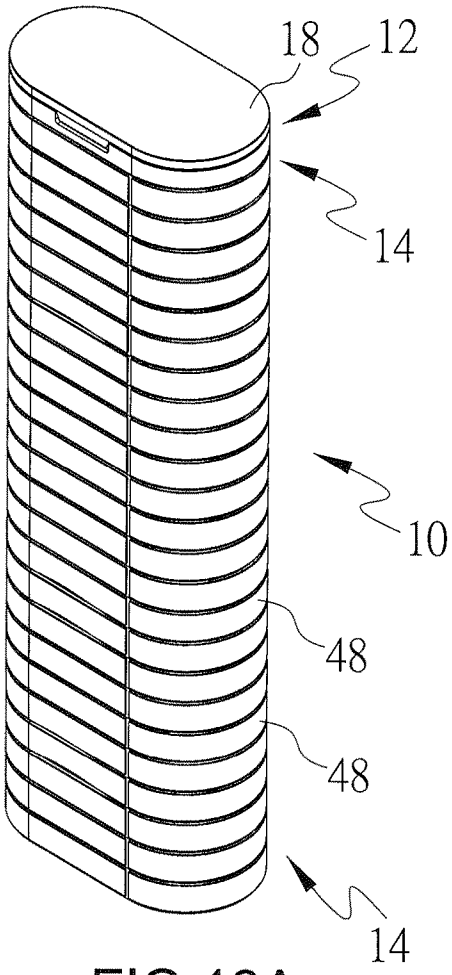
Figure 14C:
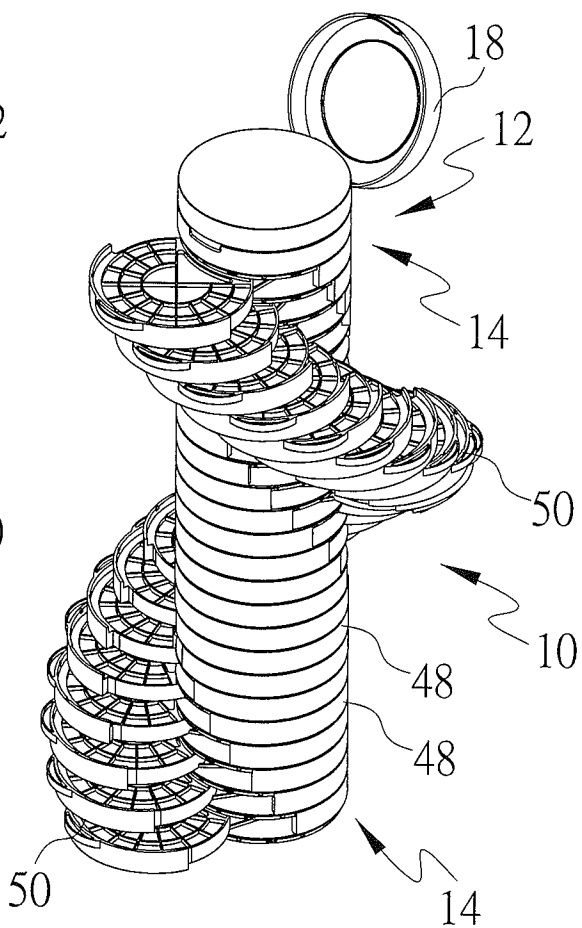
FIGS. 14A, 14B, and 14C are a perspective view and two schematic views of a stackable storage box in use according to an eighth embodiment of the present invention, respectively.
Figure 14B:
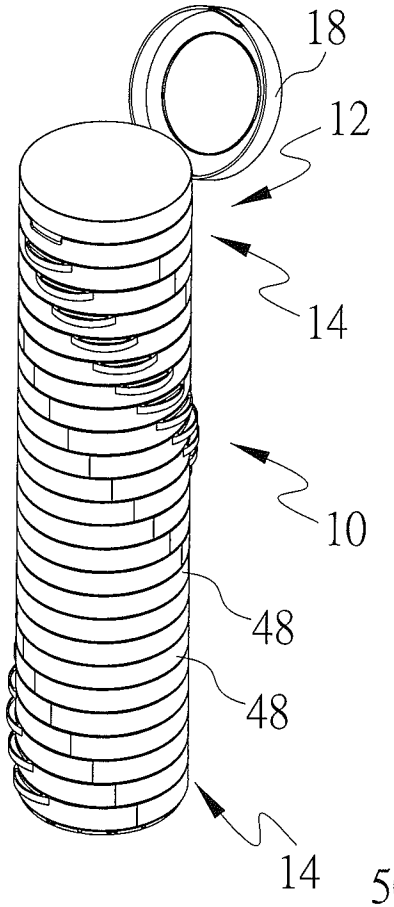
Figure 14A:
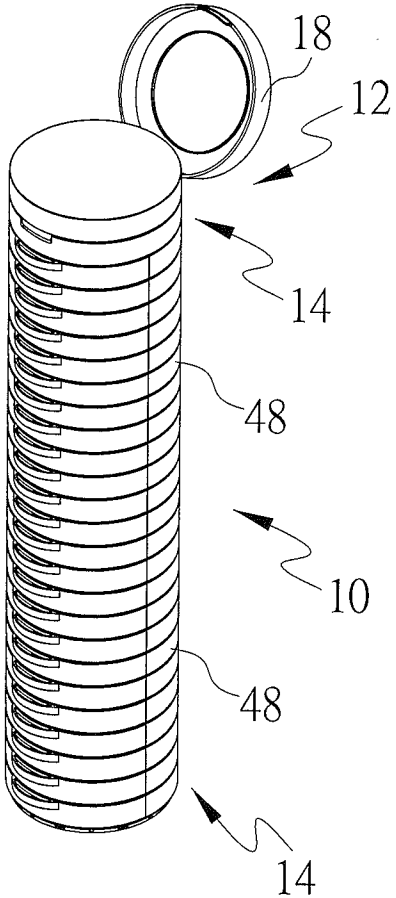

In this embodiment of FIG. 1 through FIG. 6, the upper box body 12 and the storage unit 14 of the storage box 10 are rectangular components. In other feasible embodiments, the upper box body 12 along with the storage units 14, however, present circles (FIG. 10), squares (FIG. 11A), ellipses (FIG. 13A) or other geometric shapes, respectively. As shown in FIGS. 11A, 12A, 13A and 14A, the drawers 50 in several layers of storage units 14 freely stacked in the storage box 10 can be pulled out in the same direction. However, each of the storage units 14 which are relative to the upper box body 12 for spin (see FIGS. 11B, 12B, 13B and FIGS. 14B and 14C) can present a distinct angle relative to the upper box body 12, and two adjacent storage units 14 are positioned with the upper and lower positioning portions 86 and 66 combined. As such, the openings 58 of the lower bases 46 of the storage units 14 are not aligned, and the pulled drawers 50 present staggered conditions for exhibition of articles held in the drawers 50 and a special shape of the storage box 10.

The scope of the invention is to be indicated by the appended claims, rather than by the foregoing description, and all changes which come within the meaning and range of equivalency of the claims are intended to be embraced therein.

The invention claimed is:

1. A stackable storage box comprising:

an upper box body including a box bottom and a box lid pivotally fitted at the box bottom, with the box bottom including a bottom panel and a wall panel upward extending from the bottom panel, with the bottom panel provided with a rotary portion and a positioning portion located on a bottom surface of the bottom panel and including a plurality of indents circularly distributed; and a first storage unit including a lower base, an upper base, and a drawer, with the lower base including a lower base plate having a storage space therein, with the lower base plate provided with a lower rotary portion and a lower positioning portion located on a bottom surface of the lower base plate and including a plurality of indents circularly distributed, with the upper base coupled with the lower base and including an upper base plate spaced from the lower base plate of the lower base, with the upper base plate including a top surface on which an upper rotary portion rotatably coupled with the rotary portion of the box bottom is designed, with the upper box body rotatably coupled with the upper base of the first storage unit, with an upper positioning portion formed on the top surface of the upper base plate and including a plurality of convex portions circularly distributed and correspondingly coupled with the plurality of indents of the positioning portion.

2. The stackable storage box according to claim 1, further comprising:

a second storage unit rotatably coupled with and located under the first storage unit, with the second storage unit including a lower base, an upper base coupled with the lower base, and a drawer, with the lower base of the second storage unit including a lower base plate having a storage space therein, with the lower base plate of the second storage unit provided with a lower rotary portion and a lower positioning portion located on a bottom surface thereof and including a plurality of indents circularly distributed, with the upper base of the second storage unit including an upper base plate having a top surface on which an upper rotary portion rotatably coupled with the lower rotary portion of the first storage unit is designed, with an upper positioning portion formed on the top surface of the upper base plate of the second storage unit and including a plurality of convex portions circularly distributed and correspondingly coupled with the plurality of indents of the lower positioning portion of the first storage unit.

3. The stackable storage box according to claim 1, wherein the rotary portion is a round through-hole located within the positioning portion and penetrating from a top surface to the bottom surface of the bottom panel, with the lower rotary portion being a round through-hole located within the lower positioning portion and penetrating from a top surface to the bottom surface of the lower base plate, with the upper rotary portion being a round shaft collar located within the upper positioning portion and upward protruding from the top surface of the upper base plate.

4. The stackable storage box according to claim 3, wherein a plurality of elastic flaps is formed on the shaft collar, with two gaps respectively defined in two sides of each elastic flap, with each elastic flap being flexibly movable in a radial direction of the shaft collar.

5. The stackable storage box according to claim 3, wherein a plurality of guide tracks and a plurality of stop blocks are provided on the top surface of the lower base plate.

6. The stackable storage box according to claim 1, wherein the plurality of indents of the positioning portion is spaced at a constant angle, with the plurality of indents of the lower positioning portion spaced at a constant angle, with the plurality of convex portions of the upper positioning portion spaced at a constant angle.

7. The stackable storage box according to claim 1, wherein the lower base further includes an enclosure downward extending from an edge of the lower base plate, with the upper base further including an enclosure downward extending from an edge of the upper base plate and joining an exterior of the enclosure of the lower base.

8. The stackable storage box according to claim 1, wherein the box bottom internally defines a storage bay to accommodate a tray.

9. The stackable storage box according to claim 2, wherein the rotary portion is a round through-hole located within the positioning portion and penetrating from a top surface to the bottom surface of the bottom panel, with the lower rotary portion being a round through-hole located within the lower positioning portion and penetrating from a top surface to the bottom surface of the lower base plate, with the upper rotary portion being a round shaft collar located within the upper positioning portion and upward protruding from the top surface of the upper base plate, with the shaft collar having an outer diameter almost identical to a pore size of the rotary portion.

10. The stackable storage box according to claim 9, wherein a plurality of elastic flaps is formed on the shaft collar, with two gaps respectively defined in two sides of each elastic flap, with each elastic flap being flexibly movable in a radial direction of the shaft collar.

* * * * *